United States Patent [19]

Burke, Jr.

[11] Patent Number: 4,519,783

[45] Date of Patent: May 28, 1985

[54] SWIMMER'S RESTRAINING APPARATUS

[76] Inventor: Earl P. Burke, Jr., c/o Peltex, 1100 Louisiana, 50th Floor, Houston, Tex. 77002

[21] Appl. No.: 439,927

[22] Filed: Nov. 8, 1982

[51] Int. Cl.[3] ..... A63B 69/12

[52] U.S. Cl. ..... 441/117; 441/24; 114/296; 206/829; 220/DIG. 19; 272/71

[58] Field of Search ..... 272/71; 114/296; 441/25, 26, 23, 24, 115, 117; 248/362, 363, 205.5; 206/829; 220/DIG. 19

[56] References Cited

U.S. PATENT DOCUMENTS

| | | | |
|---|---|---|---|
| 727,444 | 5/1903 | Recordon | 441/115 |
| 1,271,442 | 7/1918 | Del Fungo-Gierg | 114/296 |
| 1,617,061 | 2/1927 | La Pierre | 441/117 |
| 3,051,117 | 8/1962 | Hunter | 248/362 |
| 3,093,848 | 6/1963 | Schick et al. | 441/26 |
| 3,832,746 | 9/1974 | Korsgaard | 441/24 |
| 3,988,020 | 10/1976 | Carter | 272/71 |
| 4,074,380 | 2/1978 | Parker | 441/26 |
| 4,218,056 | 8/1980 | Whitling | 272/71 |

FOREIGN PATENT DOCUMENTS

| | | | |
|---|---|---|---|
| 2303694 | 8/1974 | Fed. Rep. of Germany | 272/71 |

*Primary Examiner*—Trygve M. Blix
*Assistant Examiner*—Thomas J. Brahan
*Attorney, Agent, or Firm*—Arnold, White & Durkee

[57] ABSTRACT

A flotation restraint apparatus for use in a body of water comprising a longitudinal buoy of sufficient buoyancy to provide flotation along the longitudinal axis of a swimmer, an annular flotation collar connecting to the longitudinal buoy and extending about the body of the swimmer, a restraint line having one end attached radially proximate the point of attachment of the longitudinal buoy to the annular float collar, and an anchor connecting the other end of the restraint line to a fixed object.

1 Claim, 11 Drawing Figures

Fig. 1
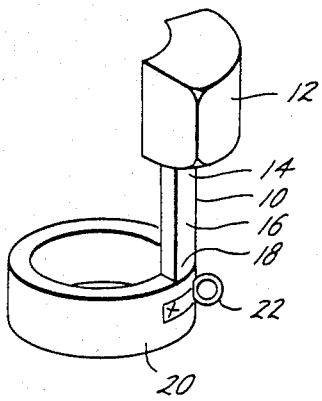
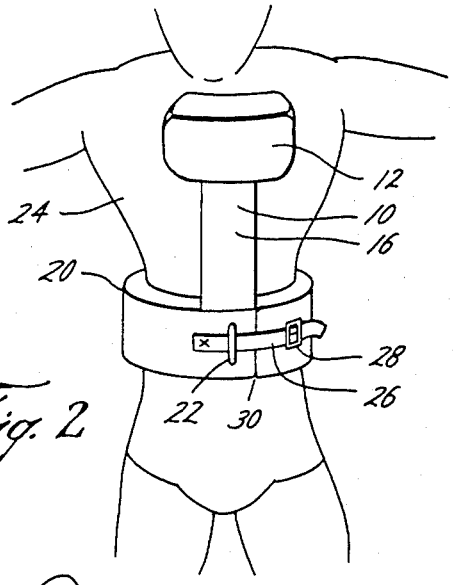
Fig. 2
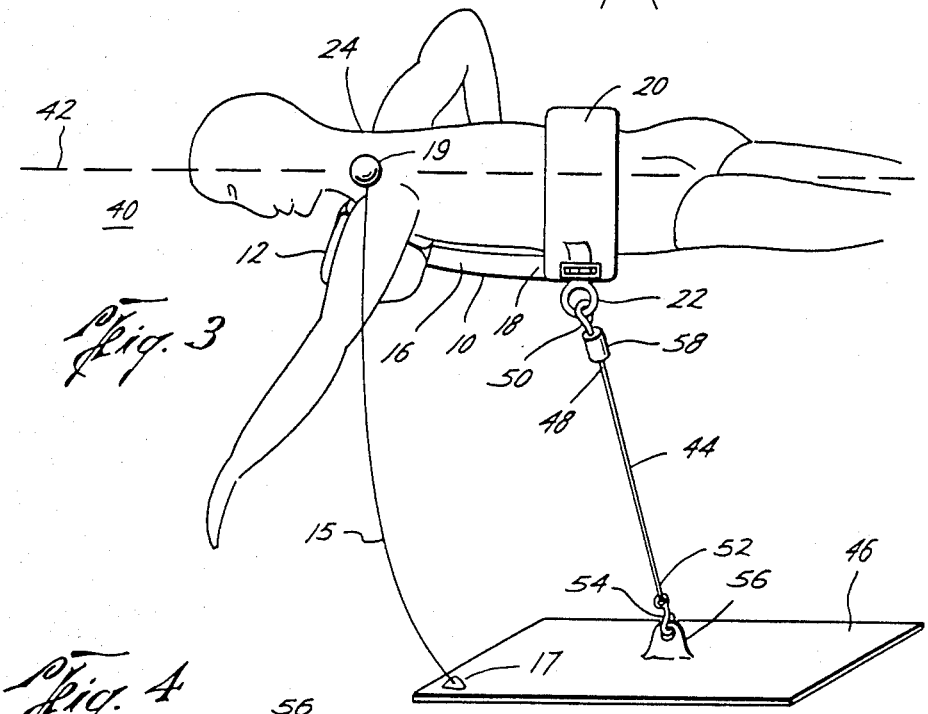
Fig. 3
Fig. 4
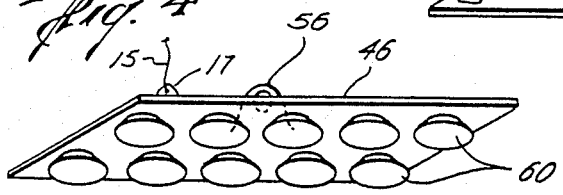

SWIMMER'S RESTRAINING APPARATUS

CROSS-REFERENCE TO RELATED APPLICATION

This is a continuation-in-part of copending U.S. application Ser. No. 258,020, now abandoned, filed Apr. 27, 1981.

TECHNICAL FIELD

The present invention is a flotation apparatus that restrains a swimmer's motion. More specifically, the present invention is an apparatus that provides flotation support and passive restraint by means of an annular flotation collar equipped with a tether and a removable longitudinal buoy member supporting the swimmer's head, whereby a swimmer may be longitudinally supported and restrained from movement without interference to the roll, pitch and yaw motions associated with normal swimming.

BACKGROUND ART

Swimming is beneficial exercise, especially in physical therapy. Often some type of flotation support and/or restraint is desirable either to allow normal swimming exercise in a confined body of water, such as a hot tub or a small part of a large pool, or because a swimmer undergoing physical therapy is injured in such a manner that flotation and restraint are necessary for the exercise to be conducted safely.

In the past, therefore, a number of restraint and flotation systems have been developed to permit "swimming in place".

The prior art in this field can be divided into two general types of apparatus. The first are passive restraints such as is illustrated by U.S. Pat. No. 4,109,905, wherein a simple lasso goes around the abdomen of a swimmer to provide a tether that prevents the swimmer from moving as he exercises. U.S. Pat. No. 3,988,020 also shows a passive restraint wherein a pair of flexible lines are attached to a belt on the swimmer and anchored to the side of the pool. Such devices do not provide flotation and thus accomplish only the function of allowing a swimmer to "swim in place".

The second general class of prior art in this area can be categorized as "swimming supports". These devices support a swimmer in the water and are often used for exercise in physical therapy. A good example of this type of prior art is found in U.S. Pat. No. 3,112,928, which teaches a fixed support that sits in a swimming pool or is imbedded in concrete. This support has a telescoping mast that terminates in a small platform. The swimmer balances on the platform and exercises by making swimming movements with his arms and legs. This type of device has a number of major defects. Chief among these is the fact that the swimmer must be sufficiently coordinated to balance on top of a flat slab or platform. The support is only useful so long as the swimmer does not roll off the support. This inhibits the three-dimensional body motion that accompanies normal swimming.

Another support of this type is illustrated in German Pat. No. 2,623,091, which provides for an annular belt that fits around the waist of a swimmer and is tied to two sides of a swimming pool. This device supports the swimmer in the water by tension on the restraining lines that anchor him to the side of the pool. These lines, since they are under tension, prevent the yaw motion that is normal in swimming.

Still another support of this type is suggested by U.S. Pat. No. 1,069,691, which is a life preserver with a neck support. In use, this device fails to adequately simulate the normal swimming movement by restraining head and neck movements and by emphasizing vertical, rather than longitudinal buoyancy.

Swimming is naturally a three-dimensional activity. A swimmer moves about three axes, i.e., roll, pitch and yaw, *simultaneously* in the act of properly exercising a swimming stroke. Normally a swimmer is supported by the buoyancy of water and the roll, pitch and yaw of swimming motions occur naturally. One defect common to all prior art discovered by the present inventor is that all prior art devices either do not provide flotation support or they restrain the swimmer using them from naturally exercising by preventing motion about at least one axis during the exercise. For example, U.S. Pat. No. 3,112,928, prevents motion about the pitch axis while the German Patent referred to above prevents a swimmer from rotating on the yaw axis.

It is an object of the present invention to provide a combination flotation and restraint device that allows a swimmer to engage in simultaneous rotation about all three axes, i.e., roll, pitch and yaw, whereby a swimmer may accomplish a natural swimming stroke while being supported by a flotation device passively restrained from the forward motion that would normally accompany such a stroke.

Another object of the present invention is to provide a means of accomplishing natural physical therapy in a limited space.

Still a further object of the present invention is to provide a flotation and restraint device for natural physical therapy by swimming that is simple, relatively foolproof and cheap to manufacture.

Yet still a further purpose of the present invention is to provide a restraining device whereby the swimmer is anchored to the bottom of a pool of water such that a large number of swimmers may exercise in a relatively small pool.

DISCLOSURE OF THE INVENTION

The present invention comprises a longitudinal buoy member attached at one end to an annular flotation belt that is provided with a restraining tether. The restraining tether is anchored to the bottom of the body of water utilized by the swimmer. The annular 30 flotation collar fits around the swimmer's waist and the longitudinal buoy extends from the swimmer's abdomen up his chest or back, depending on the stroke.

BRIEF DESCRIPTION OF DRAWINGS

FIG. 1 shows the portion of the present invention worn by the swimmer;

FIG. 2 shows the apparatus shown in FIG. 1 affixed to a swimmer;

FIG. 3 shows the present invention in use in a swimming pool by a swimmer;

FIG. 4 shows a restraining mat equipped with suction cups which comprises an embodiment of the restraining means of the present invention;

BEST MODE FOR CARRYING OUT THE INVENTION

Figure 5:
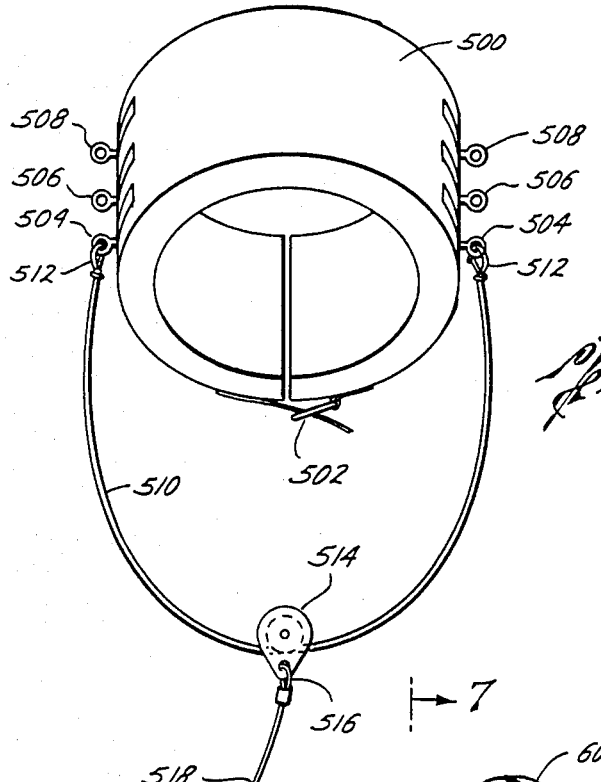
FIG. 5 shows a variation on the preferred embodiment of the present invention that uses a plurality of side attachment points for the restraining means.

In FIG. 1 a longitudinal buoy member 10 comprises a flotation mass 12 connected at one end 14 to a longitudinal arm 16.

Longitudinal arm 16 is connected at its other end 18 to an annular flotation member 20.

Annular flotation member 20 has a tether clamp ring 22 affixed by any convenient means to its outer circumference radially proximate the point of attachment of longitudinal buoy means 10.

Longitudinal arm 16 of buoy means 10 may be made of any relatively stiff material. It need not be less dense than water, though it may be less dense than water. The primary function of this longitudinal arm is to provide mechanical attachment between flotation section 12, which must be made of a material less dense than water, and flotation belt 20, which must be made of material less dense than water. Many suitable materials will be readily known to those skilled in the art of making flotation devices.

FIG. 2 shows a swimmer 24 wearing the apparatus shown in FIG. 1, above. In FIG. 2 similar numbers indicate similar structures.

Annular flotation belt 20 is shown in FIG. 2 as being equipped with a fastening belt 26 and a buckle 28. The purpose of this belt and buckle is to allow annular ring 20, which is split at point 30, to be fastened around swimmer 24's waist. It will be noted that longitudinal flotation member 10 is oriented so that its flotation portion 12 is longitudinally aligned with the swimming axis of swimmer 24 and is under either his chest or back, depending on whether he is doing a stroke that would require a swimmer to normally rest on his chest or back in the water.

By altering the attachment point between the flotation member of the present invention and its attachment means, as described below, to the bottom of a pool, a tethered swimmer can do a front stroke, i.e. a crawl or breast stroke, a back stroke or even a side stroke. Thus the present invention allows a swimmer to exercise using any of the normal swimming strokes while still obtaining the advantage of allowing a large number of swimmers to practice in a small area due to the tethering of the swimmer to the bottom of the pool, rather than to the side as is taught by the majority of the prior art.

Belt 26 and buckle 28 may be made of any material, for example, nylon, or the like, that is capable of suitably engaging such that annular flotation belt 20 does not become unfastened during exercise. After exercise, the annular flotation belt 20, along with connected longitudinal buoy member 10, may be removed by unbuckling belt 26 and buckle 28, opening split 30 in belt 20, and sliding the apparatus off the swimmer's body.

Functionally, the present invention allows a swimmer to move about all three axes of roll, pitch and yaw without any restraint or interference. This is the present invention's major improvement over the prior art. The present invention supplies flotation support along the longitudinal axis running between flotation means 12 and annular flotation means 20. This axis corresponds with the flotation axis of a swimmer.

As will be understood better from the discussion below, the portion of the present invention described in FIGS. 1 and 2, which allow normal movement of the swimmer while providing him with the normal buoyancy generated by flotation along the longitudinal axis that is congruent with the natural flotation axis of the swimmer, can be coupled with a passive restraint.

FIG. 3 shows swimmer 24 immersed in water 40 which has a water level 42.

Restraint attachment point 22 is radially proximate attachment point 18 of float or buoy member 10 and is attached by a tether 44 to a restraint mat 46, which is attached, by means that will be described below in connection with FIG. 4, to the bottom of a pool. While restraint attachment point 22 is shown in FIGS. 1–3 as occurring in one location about the annular flotation belt 20, this is not meant as a limitation on its postion about the longitudinal axis of the swimmer 24. The attachment point 22 may occur at a plurality of locations along the longitudinal axis. This type of arrangement of attachment points is illustrated by attachment rings 504, 506 and 508 in FIG. 5.

Tether 44 is attached at its upper end 48 by snap connection 50 to ring 22. Tether 44 is connected at its lower end 52 by second snap restraint 54 to an eyelet 56 formed in mat 46. The tether may incorporate an optional elastic means for allowing a swimmer doing a breast or butterfly stroke to move vertically while swimming in place. The tether itself may be elastic or it may incorporate a separate spring loaded member whose degree of elastic response is adjustable to match the requirements of individual strokes and swimmers.

Tether 44 is preferably made of some light-weight, strong material, such as nylon, that is adequate to restrain the motion of the swimmer. Mat 46 is preferably made of rubber or some other material that will not degrade in the chlorinated water of a swimming pool or hot tub. Eyelet 56 may be made of neoprene rubber or may be a metal ring bonded into the rubber surface of mat 46. A release line 15 is attached at one end to the edge of mat 46 at eyelet 17 and at its other end to floating ball 19. Release line 15 need not float on the surface of the water, but may preferably be of such a length that its buoyant member is below the water's surface where it may be easily grasped by swimmer 24 without getting in the swimmer's way when he is exercising. The swimmer 24 pulls on ball 19 to cause line 15 to pull up the edge of mat 46, thus releasing mat 14 from the pool's bottom.

The upper end 48 of tether 44 is optionally equipped with a flotation member 58, whereby it will float in an extended position such that it can be easily grasped by swimmer 24 when it is not hooked to ring 22.

Functionally, the gimbal formed by ring 22 and snap fixture 50 together with the elastic or supple quality of tether 44 and the gimbal formed by snap fixture 54 and ring member 56, allow swimmer 24 free motion around all three axes, i.e. roll, pitch and yaw. Swimmer 24 may make any swimming stroke using the present invention that an unsupported and untethered swimmer might make. The resulting motion of the swimmer's body will be natural. At the same time, for purposes of physical therapy or the like, swimmer 24 will be restrained and will be supported such that even complete exhaustion of the swimmer will only require him to raise his head above the water to stay motionless and safe. The present invention, unlike any prior art known to the inventor or located by his attorney after diligent search, provides a swimmer with longitudinal flotation support that does not require the swimmer to balance on a float and still provides the swimmer with the ability to roll, pitch and yaw in the normal motions that accompany any swimming stroke while being passively restrained.

As a result, the present invention allows a person undergoing physical therapy to exercise in an environment free of gravity loads due to the buoyancy of water. Further, recent research and distress testing has indicated that the treadmill test typically used in cardiovascular stress tests places a preponderance of load on the muscles of the leg and abdomen and does not adequately utilize or measure the cardiovascular response to exercise of the chest, upper torso and arms. The present invention allows stress testing to be accomplished using virtually all of the major muscles of the body, thus presenting a novel cardiovascular load which is more representative of the body's actual response to stress than a treadmill test. The present invention contemplates cardiovascular monitoring, by means of the electrodes attached to the swimmer's body, as is described in more detail below. It is also feasible to use the present invention over a very wide range of loads. A disabled person may exercise using the present invention without experiencing even the normal acceleration due to gravity, due to the buoyancy of water, while a competition swimmer can use the present invention to work out in any desired stroke. A strong swimmer may wish to increase the effort required to use the present invention by wearing flippers on his hands or feet, or both. The use of such flippers greatly increases the hydrodynamic drag experienced during exercise using the present invention and could be used both to prepare athletes for competition and to provide elevated cardiovascular response and stress testing. In this last use such flippers would be the functional equivalent of raising the angle of climb on a conventional treadmill stress test machine, except for the fact that the present invention allows the doctor conducting the stress test to measure the cardiovascular response of the subject to whole body activity.

Finally, the present invention allows most swimming strokes to be done in very shallow water. Experimental trials of the present invention have indicated that most strokes can be accomplished adequately in as little as two feet of water.

FIG. 4 shows a detailed view of mat 46 with ring 56.

Structurally, the underside of mat 46 is equipped with at least one suction cup 60. These suction cups 60 allow the undersurface of mat 46 to fixably attached to the bottom of the swimming pool or hot tub. This is merely one embodiment of the lower restraint means utilized by the present invention. It should be understood that the present invention can just as easily use a pad eye set in the concrete at the bottom of a swimming pool for its lower restraint member. The advantage offered by the embodiment shown in FIG. 4 is that the entire system may be easily transported from one swimming pool to another for use.

FIG. 5 is another example of the preferred embodiment of the present invention.

Annular flotation belt 500 is equipped with fastening buckle 502. A first pair of attachment rings 504, a second pair of attachment rings 506, and a third pair of attachment rings 508 are longitudinally spaced apart on opposite sides of flotation belt 500. A freely running line 510 is shown attached at its ends to the pair of rings 504 by clips 512. Ring pairs 504, 506 and 508 may be attached by a canvas strap, buckle, or any other convenient fastening means to flotation belt 500.

Line 510 passes through a pulley 514 which is attached by clip 516 to one end of tether line 518. The other end of tether line 518 is attached by clip 520 to restraining means 522. Tether 518 is preferably equipped with a flotation device whereby the tether is rendered easy to grasp by the swimmer. Restraining means 522 is attached to the bottom 524 of a pool by any convenient fastening means.

Functionally, the embodiment of the invention shown in FIG. 5 illustrates how the annular flotation belt 20 shown in FIG. 3, above, can be used to provide three axes freedom to a tethered swimmer without the chest and head support 12, described above.

By spacing rings 502, 506 and 508 radially opposite and longitudinally apart on flotation belt 500, a swimmer, not shown, using this embodiment of the present invention may make a forward swimming stroke without his head pitching down into the water. The swimmer's center of flotation is either at or below the point of attachment.

Thus, the result of using this embodiment of the present invention is to allow a swimmer to make roll, pitch and yaw movements normally associated with swimming without the need for a forward flotation support to restrain the diving moment that is produced by a forward stroke using the embodiment of the present invention shown in FIG. 3, above.

Figure 6:
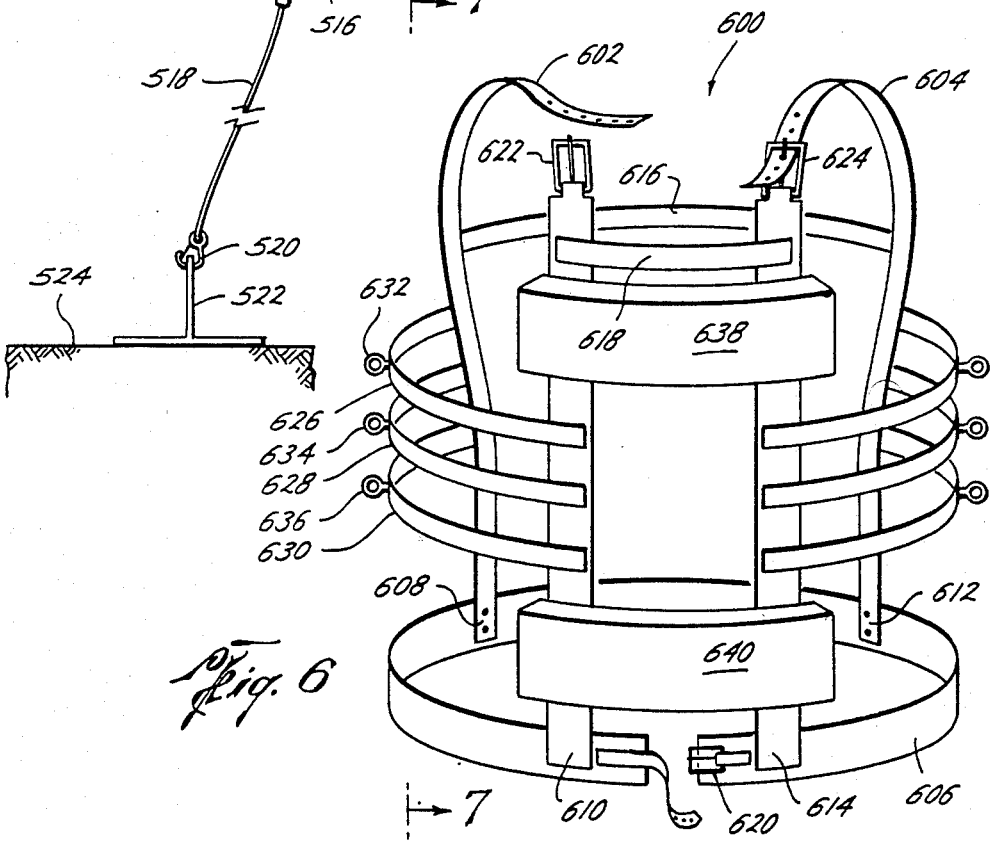
FIG. 6 shows a vest-like embodiment of the present invention equipped with movable flotation members.

FIG. 6 shows a vest embodiment of the present invention.

Structurally, web harness 600 comprises a first shoulder support web 602 and a second shoulder support web 604. Shoulder support webs 602 and 604 are joined at their bottom by waist web 606. Waist web 606 is attached by rivet, sewing, or any other convenient means to the lower ends of shoulder web 602 at attachment points 608 and 610; and to the lower end of shoulder web 604 at attachment points 612 and 614.

Shoulder webs 602, 604 are joined by stitching, rivets or any other convenient means to rear upper body cross-web 616 and front upper body cross-web 618.

Waist web 606 is equipped with an adjustable buckle means 620 located on the front of the webbing. This buckle means 620 may be a standard tongue and eyelet buckle or a strip of Velcro TM or the like.

Shoulder web 602 is split at its upper end with a shoulder height adjustment buckle 622, which may also be a conventional buckle or a strip of Velcro TM. Similarly, shoulder web 604 is equipped at its uppermost extremity with an adjustment buckle 624. Shoulder web 602 is joined front to back by transverse ring attachment webs 626, 628 and 630. The ends of these side ring attachment webs are attached by sewing, snaps, or the like to the front and back portions of shoulder web 602. A ring is attached by any suitable means at the center of each set of attachment webs. Ring 632 is attached to web 626; ring 634 is attached to web 628; and ring 636 is attached to web 630.

Figure 7:
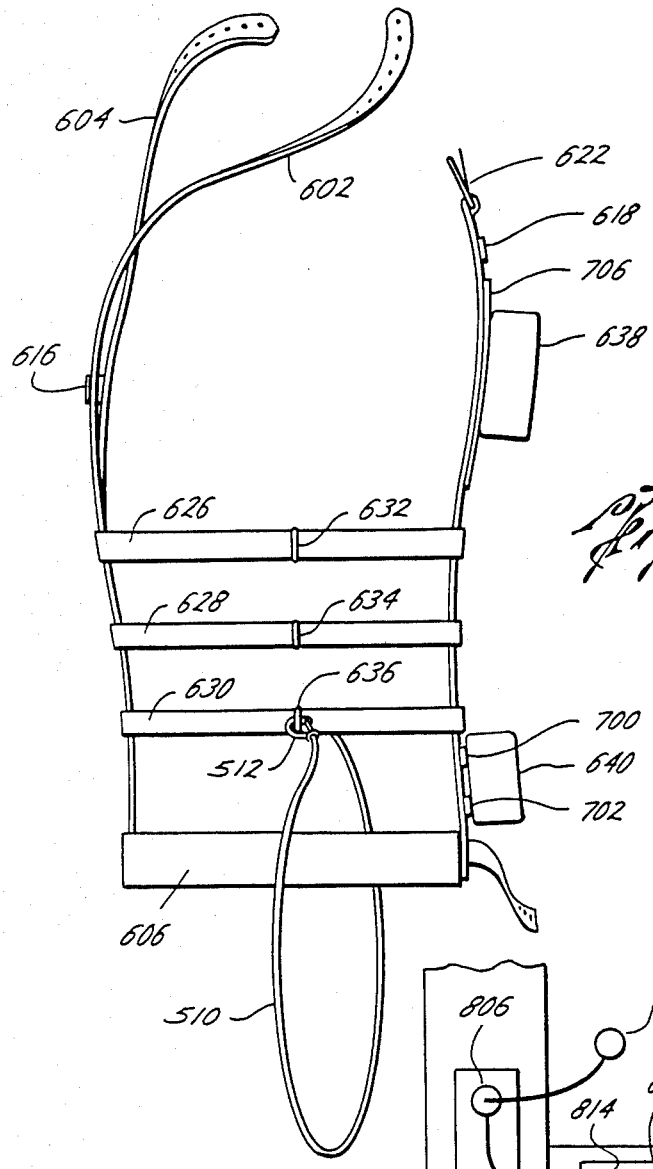
FIG. 7 shows a side view of the embodiment shown in FIG. 6 taken along section lines 7—7.

As shown in FIG. 6, the front portion of shoulder webs 602 and 604 are provided with Velcro TM, a type of synthetic material which adheres when pressed together, so as to removably anchor one or a plurality of flotation pads that are equipped with similar mating Velcro TM strips. FIG. 7 provides a side view of the location of the Velcro TM strips as between the flotation pads and the shoulder webs. Although Velcro TM is the attachment means as indicated by FIGS. 6 and 7, a plurality of snaps or the like could also be used to anchor the flotation pads to the shoulder webs.

In FIG. 6 the harness 600 is shown equipped with an upper float 638 and a lower float member 640.

FIG. 7 is a side view of the vest embodiment of the present invention shown along lines 7—7 of FIG. 6. In FIG. 7 similar numbers indicate similar structures.

Structurally, FIG. 7 shows Velcro TM strips 700 and 702, which hold flotation pad 640 to the front of shoulder web 602. Likewise, Velcro TM strips 706 hold flotation member 638 to the Velcroed front of shoulder web 602.

Functionally, FIGS. 6 and 7 illustrate an adjustable vest structure 600 that is provided with a plurality of side snap rings 636, 634, and 632, to which a tether line, such as tether line 510, can be attached. This gives the vest structure the advantage possessed by the embodiment of the present invention shown in FIG. 5, i.e. that by attaching the tether line 510 to different sets of snap rings spaced longitudinally apart on the swimmer's body, the point of attachment of the restraint device taught by the present invention may be made to coincide with the center of buoyancy of the swimmer's body, thus preventing the swimmer's head from diving when the swimmer engages in a normal swimming stroke while still permitting full freedom of motion about all three axes.

Additionally, Velcroing, or providing a plurality of snaps to the front of shoulder webs 602 and 604 allows one or more flotation pads, e.g., 638 and 640, to be attached at any longitudinal position along the swimmer's harness. The ability to change the position of these floats alters the swimmer's center of buoyancy and, in the case of a severely handicapped swimmer, allows for the provision of a head support float, i.e., float 638 in FIG. 7.

The result obtained by the embodiment of the present invention shown in FIGS. 6 and 7 is that a swimmer wishing to exercise by swimming in place may, by using the present invention, selectively attach the restraining means to that set of rings which coincides with the swimmer's center of gravity. The present invention may be used either with or without flotation means and by varying the point of attachment and number of flotation means and point of attachment of the restraining means, the swimmer may exercise using a natural swimming stroke employing movement about all three of the body's natural axes while still having his head supported and avoiding diving the forward section of his body, including the head, that occurs when the center of attachment is below the center of buoyancy and the swimmer makes a forward swimming stroke.

The web harness provides the capability to electrically monitor the swimmer's vital signs, i.e. heartbeat, etc. by well known means.

Figure 8:
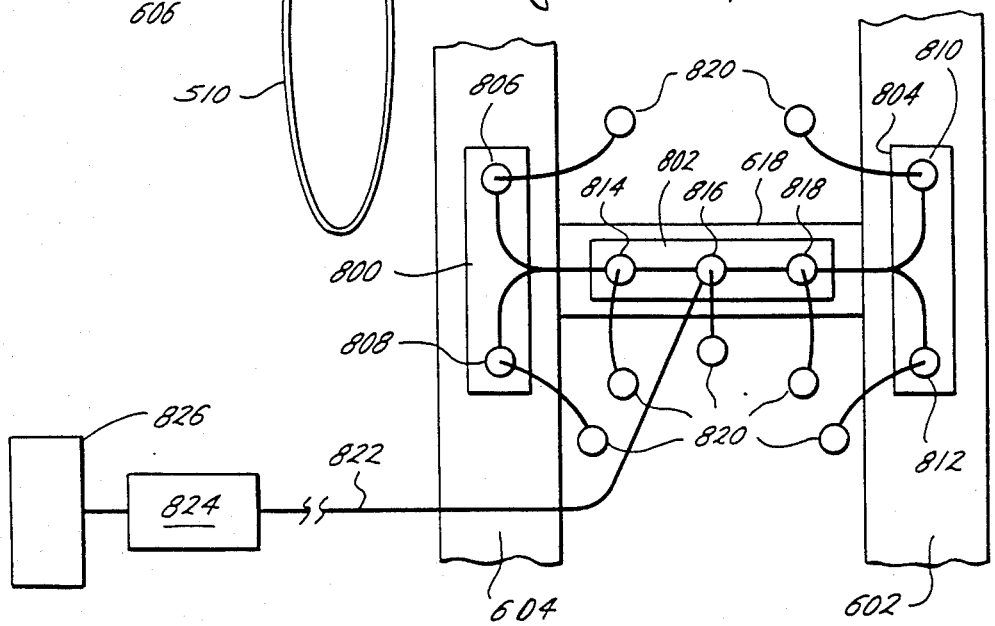
FIG. 8 shows how the embodiment shown in FIGS. 6 AND 7 may be equipped for electronically monitoring vital signs.

In FIG. 8 shoulder harness straps 604 and 602 and front upper body cross web 618, are equippable with Velcro TM strips 800, 802, 804, which are provided with a plurality of electrode attachments 806, 808, 810, 812, 814, 816, 818. These electrode attachments lead by wires to bodyconnecting electrodes 820 for monitoring vital functions, such as heart rate, etc., in a well known manner.

Electrode attachments 806, 808, 810, 812, 814, 816, 818 are joined in a cable bundle 822 which leads to a waterproof mini receiver/amplifier 824, which translates and transfers the signals to an appropriate vital signs monitoring means 826.

Whether the present invention is used for physical therapy or for training athletes for competition, a mechanical or electronic tension scale may be provided between the harness and the tether. This means of reporting tension would allow a remote observer, i.e. a swim coach or physical therapist, to electronically monitor and record, as well as to observe, the intensity and duration of exercise performed by a number of patients or athletes. This is particularly important because it allows quantification of effort expended on the part of many simultaneous swimmers. In the past there has been no convenient way of providing such measurements. Thus, the present invention is a tool by which a swim coach or a physical therapist may quantitatively provide therapy and training with great precision.

Figure 9:
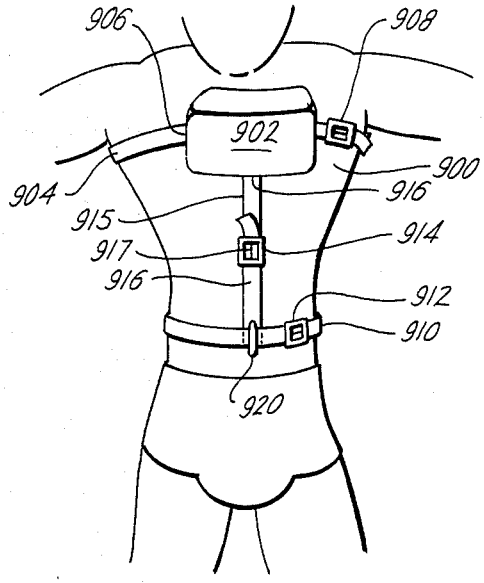
FIG. 9 shows an embodiment of the present invention having a belted flotation member.
Figure 10:
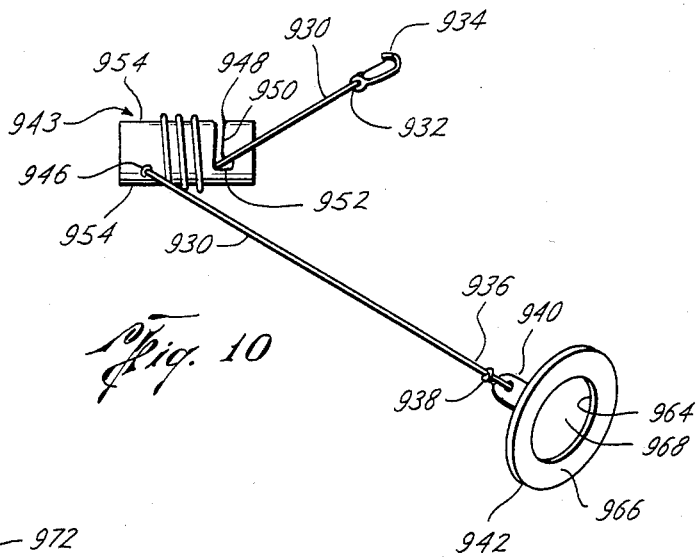
FIG. 10 shows an isometric view of the tether and anchor arrangement of the embodiment of FIG. 9.
Figure 11:
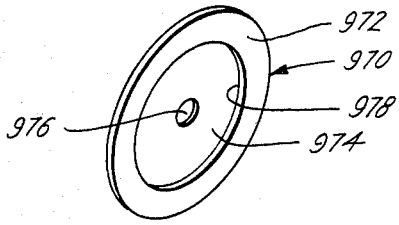
FIG. 11 is an isometric view of a suction cup mating plate to the anchor of FIG. 10.

Another embodiment of the present invention is depicted in FIGS. 9–11. In FIG. 9, longitudinal buoy 900 comprises a flotation mass 902 and a belt 904 extending therefrom. Flotation mass 902, as mentioned hereinbefore, is made of material of less density than water and of sufficient buoyancy to provide flotation along the longitudinal axis of the swimmer. Belt 904 has one end 906 secured to one side of flotation mass 902. Connected to the opposite side of the flotation mass is a buckle 908 of sufficient size and shape for coupling with the other end of belt 904. Belt 904 is adjustable for fitting various sizes of persons and for fitting various locations about the torso of the person. This belted arrangement on the longitudinal buoy member permits the swimmer to properly adjust the location of the flotation mass about his body, so as to provide for the proper center of flotation.

An adjustable belt 910 extends generally about the waist of the swimmer. Belt 910 has male/female snap connections 912 at its ends. Snap connection 912 permits the quick and simple release of the belt whenever the wearer of the belt desires to remove it. This belt 910 should be adjustable so as to fit the varying dimensions of swimmers. Belt 910 is connected to flotation mass 902 through adjustable strip 914. Strap 914 has two sections 915 and 916. Section 915 is attached, at its upper end, to flotation mass 902. The other section 916 is attached by sewing, or other suitable method, to adjustable belt 910. Sections 915 and 916 are connected together by lacing section 916 through the buckle 917 of section 915. Strap 914 extends along the longitudinal axis of the swimmer. Strap 914 may be made of any material, for example, nylon or the like, that is capable of suitably engaging such that the flotation mass does not disconnect from belt 910.

A ring 920 is attached to the bottom side of belt 910. Ring 920 is adjacent to snap connection 912. In combination with belt 910 and belt/buckle arrangement 914, ring 912 connects with the restraint, as seen in FIG. 10, so as to maintain the swimmer in a stationary position in a body of water.

FIG. 10 illustrates the tether and the anchor arrangement of this embodiment. Tether 930 is a flexible line attached at its upper end 932 by snap connection 934 to ring 920. Tether 930 is connected at its lower end 936 by a closed loop 938 passing through eyelet 940 of anchor 942.

Between the upper end 932 and the lower end 936 of tether 930 is an adjustment means 943. This adjustment means is a light-weight piece of material, preferably wood, having a hole 946 extending through one corner and a slot 948 occurring near the opposite corner. Slot 948 has a narrow passageway 950 extending through the block and having a wider notch 952 occurring at the end of passageway 950 within the block. Tether 930 passes through hole 946 and wraps about the edges 954 of the block 943. The upper end of the tether passes through notch 952. This adjustment means 943 offers an inexpensive method of adjusting the length of the tether in relation to the depth of the water in which the swimmer desires to swim. Where the depth is small, the tether is wrapped around the exterior of the block so that the distance between upper end 932 and lower end 936 is comparable to the depth of the water. On the other hand, where the swimmer desires to swim in water of greater depth, the tether is unraveled from the exterior of the block until a sufficient length is provided.

Anchor 942 is a mat preferably made of rubber or some other material that will not degrade in the chlorinated water of a swimming pool or hot tub. Anchor 942 is equipped on its top side with raised eyelet 940. Eyelet 940 may be made of wood, or other suitable material, fixedly mounted toward the center of anchor 942. On its bottom side, anchor 942 has a single suction cup 964 capable of removably affixing the anchor to a fixed object, such as the bottom of a swimming pool. Suction cup 964 comprises a single annular section of elastomeric material 966 concentric with anchor 942. Section 966, at its outer diameter, extends flush with the outer diameter of the anchor. The elastomeric material 966 should be smooth along its bottom surface, that is, the surface engaging the swimming pool. Annular area 968 acts, in combination with section 966, as the single suction cup of this embodiment. The annular arrangement provides strong attachment forces to irregular surfaces, such as the stucco bottom of a swimming pool. Anchor 942 strongly adheres to the bottom of the pool despite the strong bending forces imparted on raised eyelet 940 through flexible line 930. However, the anchor is easily separated from the bottom of the pool by a gentle upward tug on the outer diameter of the suction cup.

FIG. 11 is an isometric illustration of the suction cup mating plate 970. The bottom area 972 is a generally flat disk made of plastic or other nonabsorbent material. The diameter of disk 972 is greater than the outer diameter of anchor 942. A raised mating area 974 is permanently mounted to the top of disk 972. Mating area 974 has an outer diameter generally matching the annular area 968 of the suction cup in anchor 942. Area 974 has an aperture 976 occurring about its center point. Generally, mating area 974 has a height 978 equivalent to the depth of the suction cup of anchor 942. The mating plate, when installed into suction cup 964, serves to prevent warpage and deterioration of the suction cup during storage.

FIGS. 9–11 illustrate an inexpensive alternative version of the swimmer's restraining apparatus. Since the belts permit the longitudinal buoy member to fit all sizes, the buoy member can be mass produced at lower costs. The belted arrangement may also be more comfortable to the swimmer.

It should be understood that those skilled in the art of swimming equipment and float design may make many minor changes to the present invention. The embodiments shown above are illustrative only and are not intended to limit the scope of the present invention, which should be interpreted only according to the appended claims and their legal equivalents.

I claim:

1. An apparatus for restricting the longitudinal movement of a swimmer in a body of water comprising:

a floatation mass of material of less density than water and of sufficient buoyancy to provide flotation along the longitudinal axis of said swimmer;

an adjustable strap attached to and connecting opposite sides of said flotation mass;

an adjustable belt for removably fastening about the waist of said swimmer;

a strip demountably coupling said flotation mass and said adjustable belt in fixed relationship, one end of said strip being attached to said flotation mass and the other end being attached to said belt;

a connection ring extending a fixed distance from said belt;

a flexible line having a snap fitting at one end, said snap fitting removably attached about said connection ring;

an anchor being equipped on one side with a raised eyelet and on the other side with a suction cup capable of removably affixing said anchor to a fixed object, said raised eyelet engaging other end of said flexible line;

adjustable means about said flexible line for varying the length of said flexible line in relation to the depth of said body of water; and a suction mating plate, said plate having a generally flat disk on one side and a suction matig area on the other side, said suction mating area having an outer diameter generally matching the inner diameter of said suction cup, said suction mating plate being removably inserted into other side of said anchor.

* * * * *

UNITED STATES PATENT AND TRADEMARK OFFICE

CERTIFICATE OF CORRECTION

PATENT NO. : 4,519,783

DATED : May 28, 1985

INVENTOR(S) : Earl P. Burke, Jr.

It is certified that error appears in the above-identified patent and that said Letters Patent is hereby corrected as shown below:

Claim 1, line 47, please delete "adjustable" and in its place substitute --adjustment--.

Signed and Sealed this

*Twenty-fifth* Day of *February 1986*

[SEAL]

*Attest:*

DONALD J. QUIGG

*Attesting Officer*

*Commissioner of Patents and Trademarks*